United States Patent [19]

Mori

[11] 4,151,806

[45] May 1, 1979

[54] MULTIPLE-STITCH ZIGZAG STITCHING DEVICES FOR SEWING MACHINES

[76] Inventor: Katsuji Mori, 12-2, Chidori-cho 3-chome, Ogaki-shi, Gifu-ken, Japan, 503

[21] Appl. No.: 829,459

[22] Filed: Aug. 31, 1977

[30] Foreign Application Priority Data

Aug. 31, 1976 [JP] Japan ..... 51-116493[U]

[51] Int. Cl.[2] ..... D05B 3/04; D05B 3/24

[52] U.S. Cl. ..... 112/160

[58] Field of Search ..... 112/160, 157, 77, 235, 112/240

[56] References Cited

U.S. PATENT DOCUMENTS

| | | | |
|---|---|---|---|
| 2,849,975 | 9/1958 | Wurker | 112/160 |
| 3,039,412 | 6/1962 | Kodera et al. | 112/160 |
| 3,062,165 | 11/1962 | Utz | 112/77 X |
| 3,074,365 | 1/1963 | Enos | 112/160 |

*Primary Examiner*—Peter Nerbun

*Attorney, Agent, or Firm*—Irvin A. Lavine

[57] ABSTRACT

A multiple-stitch zigzag stitching device for a sewing machine comprises a vertical swinging member rotatably supported on a base and adapted for rotation upon vertical movement of a needle bar on the sewing machine, and a horizontal swinging member rotatably supported by the base and carrying a ratchet wheel to which a cam is eccentrically attached. A fabric holding member is connected to the horizontal swinging member for horizontal rotation therewith. A locking member has one end connected to the vertical swinging member and another end engaged with the outer periphery of the ratchet wheel on which a number of teeth are provided. Vertical rotation of the vertical swinging member causes horizontal reciprocatory movement of the locking member to rotate the ratchet wheel intermittently to thereby rotate the eccentric cam, so that the horizontal swinging member is rotated horizontally to permit horizontal reciprocatory movement of the fabric holding member.

3 Claims, 8 Drawing Figures

MULTIPLE-STITCH ZIGZAG STITCHING DEVICES FOR SEWING MACHINES

This invention relates to a multiple-stitch zigzag stitching device for use with a conventional straight-stitch sewing machine to enable the latter to perform multiple-stitch zigzag sewing opration.

No conventionally known straight-stitch sewing machine is able to perform multiple-stitch zigzag sewing without a converting attachment. It is, therefore, an object of this invention to provide a novel and improved multiple-stitch zigzag stitching device or attachment for use with a straight-stitch sewing machine. It is important to avoid breakage of a thread or application of excessive tension on the thread, especially in the case of a knitted or other type of fabric which may undergo a large degree of expansion and contraction. This invention provides a multiple-stitch zigzag stitching device which can readily be used with a conventional straight-stitch sewing machine to easily accomplish multiple-stitch sewing operation, including hem-stitching of an easily expansible fabric.

The invention will now be described in further detail by way of example with reference to the accompanying drawings, in which.

Figure 1:
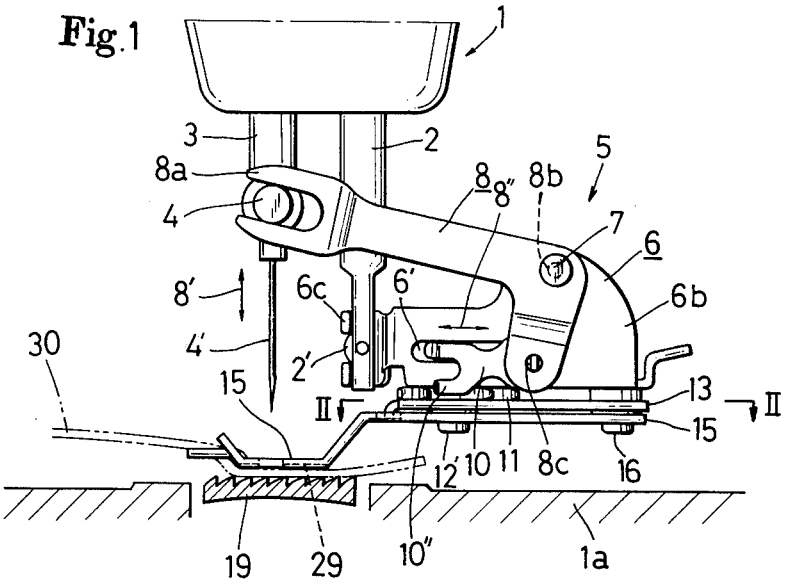
FIG. 1 is a side elevational view showing the device embodying this invention as installed on a sewing machine.
Figure 7:
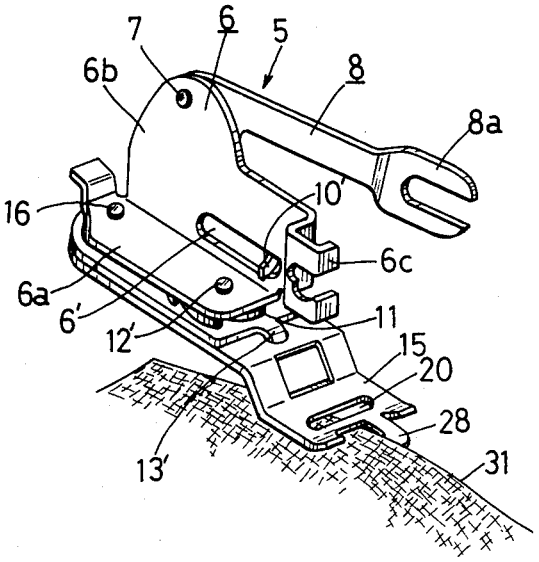
FIG. 7 is a perspective view of the device embodying this invention.

Referring to the drawings more particularly, the device of this invention includes a base 6 having a substantially L-shped vertical cross-section and formed by a horizontal bottom portion 6*a* and a vertical side portion 6*b* integrally joined with the bottom portion 6*a* substantially at right angles thereto as shown in FIG. 7. The vertical portion 6*b* has a front end projecting beyond the front end of the bottom portion 6*a* and formed with an inwardly bent, right-angled projection which defines a mounting member 6*c* to mount the device of this invention on a sewing machine as shown in FIG. 1. The mounting member 6*c* is bifurcated for the purpose which will hereinbelow become clear. The vertical portion 6*b* is provided with a slit opening 6' adjacent to its front end and which is parallel to the bottom portion 6*a*. A vertical swinging lever 8 is an L-shaped member which includes a generally horizontally extending elongate arm having a bifurcated free end 8*a*. The vertical swinging member 8 is provided with a hole 8*b* adjacent to its corner and another hole 8*c* at its lower end remote from the bifurcated free end 8*a* as shown in FIG. 1.

Figure 3:
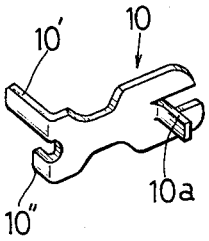
FIG. 3 is a perspective view showing a bifurcated member.
Figure 4:
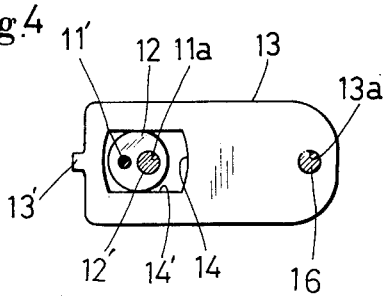
FIG. 4 is a top plan view showing a horizontal swinging plate and a rotary cam engaged therewith.

The device further includes a bifurcated locking member 10 generally formed by a vertically disposed plate having a perpendicularily bent, bifurcated front end which defines an upper finger 10' and a lower finger 10'' which is considerably smaller in length than the upper finger 10' as shown in FIG. 3. The locking member 10 is further formed with a third finger 10*a* projecting in a direction opposite to that in which the upper and lower fingers 10' and 10'' extend.

Figure 2:
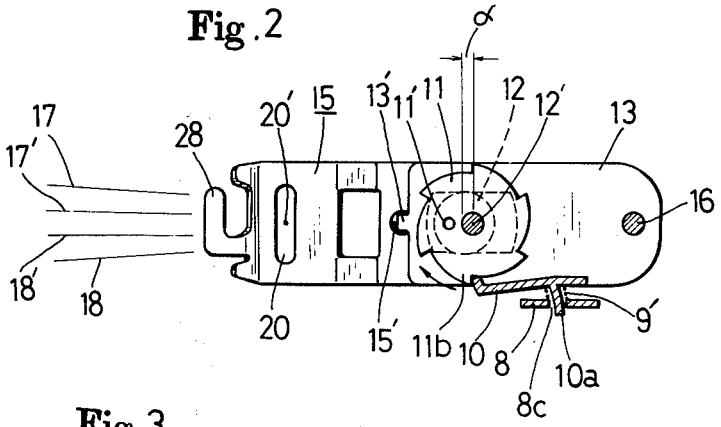
FIG. 2 is a view looking in the direction of the line II-II of FIG. 1.

The device further includes a ratchet wheel 11 having an appropriate number of teeth and to which a circular rotary cam 12 having a smaller diameter than the ratchet wheel 11 is eccentrically attached and secured by a pin 11''. The rotary cam 12 has a center spaced a distance $\alpha$ apart from the center of the ratchet wheel 11 as shown in FIG. 2. The ratchet wheel 11 is provided through its center with a hole 11*a* which is aligned with a hole provided through the cam 12. A horizontal swinging lever 13 comprises a horizontally disposed planar member having a generally straight front edge which is centrally provided with a downwardly curved lug 13'. The horizontal swinging lever 13 is further provided with a substantially rectangular opening 14 in the vicinity of the lug 13' and which extends longitudinally of the lever 13 of the generally rectangular construction. The opening 14 is adapted to receive the cam 12 therein. The lever 13 has an arcuately curved rear edge formed with a hole 13*a*.

Figure 5:
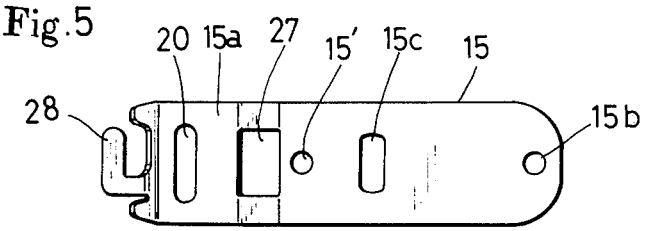
FIG. 5 is a top plan view of a fabric holding member.

A fabric holding member 15 comprises a plate which is equal in width to the horizontal swinging lever 13, but greater in length as illustrated in FIG. 2. The fabric holding member 15 includes a downwardly bent front end portion 15*a* by which the fabric is held. The front end portion 15*a* is provided on its underside with a notched, uneven surface configuration 29. The front end portion 15*a* is further provided with a slit opening 20 extending perpendicularly to the longitudinal centerline of the fabric holding member 15 as shown in FIG. 2. The fabric holding member 15 is provided with a hole 15*b* adjacent to its rear end as shown in FIG. 5 and with another circular hole 15' in the vicinity of the front end portion 15*a*. The hole 15' is adapted to receive the lug 13' therein when the horizontal swinging lever 13 is placed on the fabric holding member 15 with the hole 13*a* vertically aligned with the hole 15*b*. The fabric holding member 15 includes a downwardly inclined portion defining the front end portion 15*a* having a rectangular opening 27 which is parallel to the opening 20 as shown in FIG. 5. The front extremity of the fabric holding member 15 is upwardly bent to a certain extent as shown in FIG. 1 and provided with a hook-shaped fabric guiding member 28 extending in parallel to the opening 20 as shown in FIGS. 2 and 5. The fabric holding member 15 is further provided with an elongate aperture 15*c* which is perpendicular to the longitudinal centerline of the fabric holding member 15 as shown in FIG. 5.

For the purpose of assembling the device, the locking member 10 is placed beside the vertical portion 6*b* of the base 6 and the upper finger 10' is inserted into the slit opening 6' as shown in FIG. 7. The vertical swinging lever 8 is placed on the locking member 10 and the third finger 10*a* of the locking member 10 is inserted into the hole 8*c* as shown in FIG. 1. A coiled spring 9' is interposed between the lever 8 and the locking member 10 and encircles the finger 10*a* as shown in FIG. 2 to urge the locking member 10 for the purpose which will become clear from the following description.

A pin 7 projects outwardly from the upper corner of the base 6 into the hole 8*b* of the lever 8 as shown in FIG. 1, so that the lever 8 is rotatable about the pin 7 to effect horizontal reciprocatory movement of the locking member 10 along the slit opening 6'. The rotary cam 12 is engaged in the opening 14 of the horizontal swinging lever 13 and the ratchet wheel 11 is disposed on the horizontal swinging lever 13. The lug 13' of the horizontal swinging lever 13 is inserted into the hole 15' of the fabric holding member 15 and the hole 13*a* at the end of the lever 13 is alinged with the hole 15*b* at the end of the fabric holding member 15 to position the horizontal swinging lever 13 on the fabric holding member 15.

The lower finger 10" of the locking member 10 is engaged with one of the teeth on the ratchet wheel 11 as is obvious from FIG. 2 and the bottom portion 6*a* of the base 6 is positioned on the ratchet wheel 11 and the horizontal swinging lever 13. A pin 12' is inserted through the central hole 11*a* of the ratchet wheel 11 and the aperture 15*c* of the fabric holding member 15 and likewise, a pin 16 is inserted through the hole 13*a* of the horizontal swinging lever 13 and the hole 15*b* of the fabric holding member 15, so that the two pins 12' and 16 secure the base 6 and the fabric holding member 15 to each other. A washer of equal thickness to the ratchet wheel 11 is interposed between the base 6 and the horizontal swinging lever 13, and the pin 16 extends through that washer. The spring 9' urges the locking member 10 to maintain the lower finger 10" in engagement with one of the teeth 11*b* on the ratchet wheel 11 as shown in FIG. 2.

In order to attach the zigzag stitching device 5 of this invention to a sewing machine 1 as shown in FIG. 1, the head of a needle clamping screw 4 on the machine 1 is engaged between the fingers on the free end 8*a* of the vertical swinging lever 8. Numeral 3 indicates a needle bar and numeral 4' denotes a needle. The lower end of a presser bar 2 is held by the mounting member 6*c* on the base 6 and a lock screw 2' is tightened to secure the device 5 to the presser bar 2 in such a manner that the bottom portion 6*a* of the base 6 is maintained in parallel relation to the top surface of a bed 1*a* on the machine 1 as shown in FIG. 1.

In operation, a sheet of fabric 30 is placed on a saw-toothed fabric feeding plate 19 and the presser bar 2 is pressed down to permit the notched bottom surface 29 of the fabric holding member 15 to press the fabric 30 against the fabric feeding plate 19. The needle 4' has a longitudinal axis extending downwardly through the center 20' of the slit 20 of the fabric holding member 15. The machine 1 is placed in operation to start vertical reciprocatory movement of the needle 4' along the arrows 8' in FIG. 1. One reciprocatory movement of the needle 4' causes one reciprocatory movement of the vertical swinging lever 8 which in turn brings about one horizontal reciprocatory movement of the locking member 10 in the direction indicated by arrows 8" in FIG. 1. During the forward movement of the locking member 10, its lower finger 10" pushes the ratchet tooth 11*b* forward to rotate the ratchet wheel 11 is a clockwise direction indicated by an arrow in FIG. 2. During the backward movement of the locking member 10, the ratchet wheel 11 remains immovable and the lower finger 10" slides back along the outer periphery of another tooth on the ratchet wheel 11. Any reverse rotation of the ratchet wheel 11 is prevented by the friction which may be developed against the ratchet wheel 11 by the horizontal swinging lever 13 and the fabric holding member 15 between which the ratchet wheel 11 is squeezed when the presser bar 2 is pressed down. Thus, no particular means need be provided for preventing such reverse rotation of the ratchet wheel 11 during the backward movement of the locking member 10.

As the needle 4' makes successive reciprocatory movements, the locking member 10 causes intermittent rotation of the ratchet wheel 11 with the lower finger 10" engaged with one tooth on the ratchet wheel 11 after another. The ratchet wheel 11 is secured to the rotary cam 12 in eccentric relation thereto and rotatably supported on the pin 12' as has already been noted. As the ratchet wheel 11 rotates, the rotary cam 12 within the opening 14 of the horizontal swinging lever 13 rotates about the pin 12'. The cam 12 is maintained in contact with the edge 14' of the opening 14 throughout its rotation. During its rotation, the cam 12 causes swinging movement of the horizontal swinging lever 13 and the fabric holding member 15 about the pin 16 within the range defined by the distance $\alpha$ between the centers of the ratchet wheel 11 and the cam 12 as indicated by lines 17 and 18 in FIG. 2.

Figure 6:
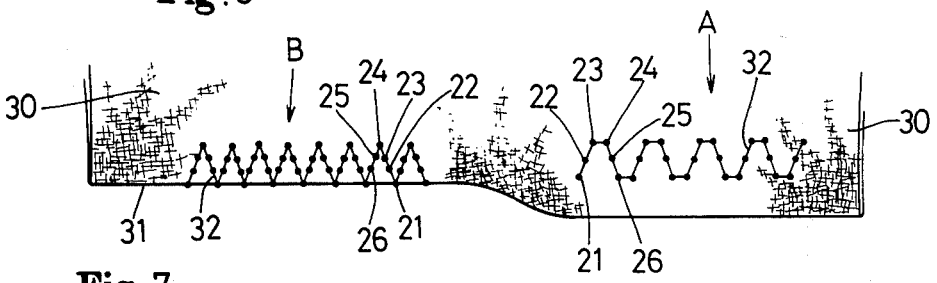
FIG. 6 illustrates two modes of multiple-stitch zigzag sewing achieved by this invention.

As shown in FIG. 2, the ratchet wheel 11 in the embodiment being described has six teeth and, during its full rotation, permits the fabric holding member 15 to stop at intermediate positions 17' and 18' between its leftmost position 17 and its rightmost position 18 relative to the base 6. During one full rotation of the ratchet wheel 11, the fabric holding member 15 may, for example, stop at, and move in the order of positions 17, 17', 18', 18' and 17'. The ratchet wheel 11 stops six times during one full rotation to permit the fabric holding member 15 to stop at the same time to cause the needle 4' to fall down through the fabric 30 six times during one rotation of the ratchet wheel 11. Thus, the device 5 provides zigzag sewing with six stitches 21, 22, 23, 24, 25 and 26 as shown at A in FIG. 6 and this is repeated as the fabric 30 is moved forward. An example of the result of zigzag sewing operation with a still greater number of stitches is shown at B in FIG. 6. Any modification or variation to the device of this invention to effect such multiple-stitch zigzag sewing operation would be obvious to anybody of ordinary skill in the art without departing from the principles of this invention.

The hook-shaped fabric guiding member 28 includes a guide groove 28*a* in which an edge 31 of the fabric 30 may be held to be thereby prevented from separation from the fabric holding member 15 during the sewing operation.

Figure 8:
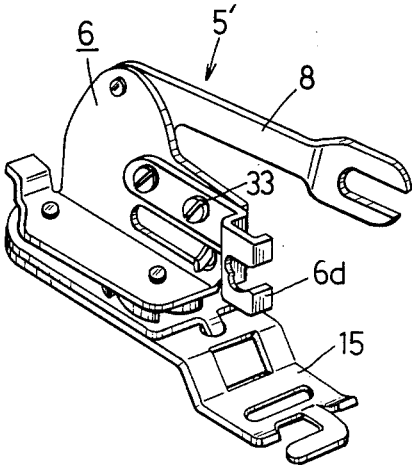
FIG. 8 is a perspective view showing a modified form of the device embodying this invention.

A modified form of the device described with reference to FIGS. 1 through 7 is shown at 5' in FIG. 8. The device 5' includes a separate mounting member 6*d* which is a part separate from the base 6 and removably secured to the base 6 by a pair of screws 33. This removable arrangement of the mounting member provides greater versatility of the device according to this invention by facilitating use of diffrently sized mounting members 6*d* to suit different sorts of sewing machines.

While the invention has been described with reference to a preferred embodiment thereof, it is to be understood that modifications or variations may be easily made by those skilled in the art without departing from the scope and spirit of this invention as defined by the appended claims.

What is claimed is:

1. A multiple stitch zig-zag stitching device for attachment to a sewing machine having a fabric feeding plate, a needle bar and a presser bar, said attachment comprising:

a base for attachment to the presser bar, a lever pivoted on said base, means on said lever engageable with the needle bar to cause vertical oscillating movement of said lever upon reciprocation of the needle bar, a fabric holding member horizontally rotatably supported at one end on said base and cooperating at the other end with the fabric feeding plate to hold the fabric to be sewn, said fabric holding member comprising means for imparting horizontal movement of said fabric during horizontal movement thereof, a ratchet wheel horizontally rotatably connected to said fabric holding member, a cam secured to said ratchet wheel for rotation therewith, engaging means carried by said fabric holding member and receiving said cam therein for horizontal rotation of said fabric holding member about said one end thereof upon rotation of said cam, and means actuated by said lever and engageable with said ratchet wheel for imparting unidirectional intermittent rotation thereto upon oscillation of said lever by the reciprocation of the needle bar.

2. The device as defined in claim 1, wherein said engaging means includes a horizontal swinging member having an opening in which said cam is engaged, and means for detachably securing said horizontal swinging member to said fabric holding member for causing said horizontal rotation of said fabric holding member upon horizontal rotation of said horizontal swinging member.

3. The device as defined in claim 1, wherein said base has a vertical portion with a horizontal slit therein, said last mentioned means having a portion adapted to be inserted into said slit in said base, and having a finger thereof engageable with said ratchet wheel, and a spring for urging said finger into engagement with said ratchet wheel.

* * * * *